US007637044B2

(12) United States Patent
Hluchan

(10) Patent No.: US 7,637,044 B2
(45) Date of Patent: Dec. 29, 2009

(54) ADVERTISING/PROMOTIONAL DISPLAY SYSTEM

(75) Inventor: Erik S. Hluchan, Deep River, CT (US)

(73) Assignee: Structural Graphics, LLC, Essex, CT (US)

( * ) Notice: Subject to any disclaimer, the term of this patent is extended or adjusted under 35 U.S.C. 154(b) by 0 days.

(21) Appl. No.: 11/893,142

(22) Filed: Aug. 15, 2007

(65) Prior Publication Data

US 2008/0047180 A1 Feb. 28, 2008

Related U.S. Application Data

(60) Provisional application No. 60/840,227, filed on Aug. 25, 2006.

(51) Int. Cl.
*G09F 7/00* (2006.01)

(52) U.S. Cl. ..... 40/492; 40/124.01; 434/404; 446/149

(58) Field of Classification Search ..... 40/492, 40/124.191, 124.01, 124.09, 124.11; 434/404, 434/405; 446/149, 151, 152, 150
See application file for complete search history.

(56) References Cited

U.S. PATENT DOCUMENTS 968,721 A * 8/1910 Weingart ..... 352/102
3,199,238 A * 8/1965 Brown ..... 40/488
3,323,242 A * 6/1967 Schoenung ..... 40/492
7,325,341 B2 * 2/2008 Mouyal ..... 40/124.01
2007/0266602 A1 * 11/2007 Daghighian ..... 40/492

* cited by examiner

*Primary Examiner*—William L. Miller
(74) *Attorney, Agent, or Firm*—Melvin I. Stoltz

(57) ABSTRACT

By providing a unique, pre-printed promotional system which can be produced in a wide variety of alternate forms and/or configurations and employs at least two cooperating panels mounted to each other, with one panel being movable for activating the movement of the second panel between an open position and a closed position, a unique, hands-on, printed, visually exciting and interest generating advertising/promotional product is attained. In the preferred embodiment, the promotional system of the present invention incorporates a panel member on which a plurality of cooperating cut out sections are formed, with each of these cut out sections being constructed for cooperating with each other in the central area or zone of the panel member. Furthermore, each cut out section is movable or arcuately pivoted between two alternate positions, with the arcuate pivoting movement being controlled by affixation of each cut out section with the cooperating, overlying activation plate.

14 Claims, 5 Drawing Sheets

ADVERTISING/PROMOTIONAL DISPLAY SYSTEM

RELATED APPLICATIONS

Figure 1:
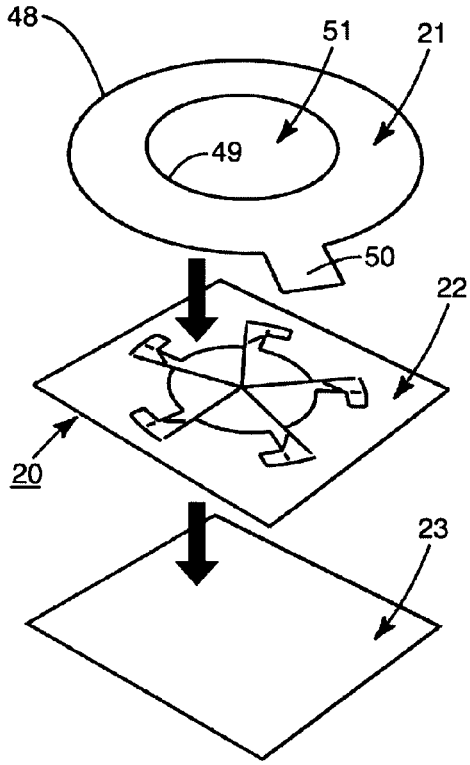

This application is related to U.S. Provisional Patent Application Ser. No. 60/840,227, filed Aug. 25, 2006 entitled ADVERTISING/PROMOTIONAL DISPLAY SYSTEM.

TECHNICAL FIELD

This invention relates to advertising/promotional display systems and, more particularly, to advertising/promotional display systems for providing visually exciting and interest generating products.

BACKGROUND ART

With the ever-increasing quantity of products and services being offered to consumers, substantial interest has been given to promotional systems for advertising such products and services. In this regard, a wide variety of advertising displays and promotional literature has been created and distributed to consumers. However, due to the deluge of material to which average consumers are constantly exposed, greater emphasis has been placed on developing eye-catching visual displays and promotional material which stand out as being visually unique in order to receive consumer attention.

Although various novelty products and printed displays have been created in an attempt to satisfy this demand, these prior art products have failed to provide the desired interest generating result with production costs which advertisers are capable of justifying. In attempting to generate a unique advertising display, some prior art products have employed complex folding systems which produce a three-dimensional display when activated or unfolded.

In spite of the unique visual appearance generated by such products, the overall cost of production and complexity of the assembly of these systems has prevented such prior art systems from becoming popular. In particular, many prior art systems require multi-part segments to be aligned or placed in specific registered positions or locations. This requirement is both time consuming and costly.

Other prior art displays have attempted to generate consumer interest by providing unique visual images or other indicia as an integral part of the display. However, these prior art attempts have also failed to generate the consumer interest being sought, largely due to an inability to physically involve the consumer in the promotion or display operation.

Furthermore, the ever increasing consumer demand seeks to obtain promotional products which produce unique and/or surprising results. In this regard, consumers are continuously seeking products which will produce a surprising visual and/or audible effect when used.

Therefore, it is a principal object of the present invention to provide a printed advertising or promotional product which is capable of being produced at a reasonable cost and provides an exciting, interest generating display.

Another object of the present invention is to provide a printed advertising or promotional product having the characteristic features described above, which enables the consumer to physically control the presentation of the display in a unique, hands-on manner.

Another object of the present invention is to provide a printed advertising or promotional product having the characteristic features described above, which is capable of mass production and assembly.

Another object of the present invention is to provide a printed advertising or promotional product having the characteristic features described above, which is completely produced and assembled without requiring special segment alignment or registration.

A further object in the present invention is to provide a printed advertising or promotional product having the characteristic features described above, which provides a unique, eye-catching, exciting and surprising visual change and/or an audible sound generation which is produced in response to action taken by the consumer.

Other and more specific objects will in part be obvious and will in part appear hereinafter.

SUMMARY OF THE INVENTION

By employing the present invention, all of the difficulties and inabilities of the prior art are eliminated and a unique, hands-on, printed, visually exciting and interest generating advertising/promotional product is attained. This desirable and previously unattainable result is realized in the present invention by providing a unique, pre-printed promotional system which can be produced in a wide variety of alternate forms and/or configurations. However, regardless of the printed form or configuration desired, the promotional system of the present invention employs at least two cooperating panels mounted to each other, with one panel being movable for activating the movement of the second panel between an open position and a closed position.

In the basic, principal construction of the present invention, the promotional system comprises two cooperating components which are affixed to each other in overlying, aligned, interengagement. Although two components are required for achieving the basic construction, the preferred embodiment of the present invention incorporates a third component which consists of an enlarged, support panel forming the base or bottom of the final assembly.

The promotional system of the present invention incorporates a panel member on which a plurality of cooperating cut out sections are formed. As detailed herein, each of these cut out sections may comprise a wide variety of alternate sizes, shapes, and configurations. However, in order to attain the overall goals and objectives of the present invention, these cut out sections are preferably constructed for cooperating with each other in the central area or zone of the panel member, with the central display area/zone comprising a substantial area or portion of the overall panel member.

In addition, each cut out section is constructed for being movable or arcuately pivoted between two alternate positions, with the arcuate pivoting movement being controlled by affixation of each cut out section with a cooperating, overlying activation plate. By moving the activation plate in a pre-defined direction, each of the cut out zones are controllably forced to arcuately pivot simultaneously in a desired manner or direction.

Furthermore, the plurality of cut out sections are preferably constructed for being aligned in cooperating relationship with each other when in a first position, effectively establishing a single, visually coordinated central display area/zone. In this first position, each cut out section is preferably formed for being in substantially, aligned, abutting relationship with each adjacent cut out section. As result of this construction, each cut out section typically comprises a portion of a message, image, visual display, etc. desired by the manufacturer or user, with the assembly of cooperating sections effectively forming the entire message, image, visual display, etc., desired.

In their second position, the cut out sections are arcuately pivoted away from each other into a position outside of the central display area or zone. As result, when the cut out sections have been moved into their second position, the message, image, visual display, etc. provided by the cooperating cut out sections effectively disappears, revealing the area directly below the cut out sections. Typically, this area contains a further message, display, visual image, etc. which is desired to be conveyed to the user or operator. This second message, display, or visual image is typically formed on the support panel which comprises the third component of the assembly of the present invention. However, if desired, the second message, display, or visual image can be formed on a plate or a component integrated with the panel member.

In the preferred embodiment of the present invention, the activation plate is constructed with an enlarged cut out zone corresponding to the size and shape of the central display zone or area established by the cut out sections formed on the panel member. In this way, whenever the activation plate is employed for moving the cut out sections from their first position into their second position, the cut out sections preferably move into a position below the activation plate, effectively disappearing from view. As result, the message, display, or visual image provided on the cut out sections is visible only when the cut out sections are in their first position, and disappears when the cut out sections are in their second position, revealing the second message, display, or visual image formed on the third components or support panel, or formed on a display sheet associated with the panel member.

One principal embodiment which is achieved by employing the construction detailed above for forming the promotional system of the present invention is the creation of a mechanical iris, wherein the cut out sections effectively form the diaphragm which opens and closes in a conventional mechanical iris. However, in accordance with this invention, any desired alternate displays, messages, or visual images can be conveyed to the user in a unique promotional system.

In addition, the user is able to directly participate in the presentation of the alternate displays, by physically moving the activation plate in order to cause a promotional display to switch between the first position in the second position. In this way, hands-on, active participation is realized, as well as enjoyment and excitement in physically participating in the use of the promotional system.

As is evident from this disclosure, the formation of the present invention with an iris-type construction merely represents one embodiment of the present invention. Clearly, numerous alternate constructions and configurations can be implemented without departing from the scope of this invention. Furthermore, the activating panel can be constructed with any size and shape, including circles, squares, rectangles, polygons, triangles, and the like.

In effect, the only requirement is that the activating panel incorporate a central aperture having an overall size and shape consistent with the central display area or zone formed by the cooperating cut out sections. In this way, whenever the activating panel is moved in the desired direction for causing the cut out sections to move from their first position into their second position, the cut out sections will effectively disappear from view, revealing the central display area or zone and the message contained directly therebelow.

Furthermore, in accordance with the present invention, the activating panel may be constructed for being manually operated or automatically operated. In this regard, in the preferred manual activation construction, the activation panel incorporates holding tab radially extending therefrom for assisting the user in manually grabbing the activating panel and moving the activating panel in the desired direction for causing the cut out sections to move between their two alternate positions.

Alternatively, automatic activation systems can be constructed for causing the cut out sections to move between their two alternate positions. In this regard, a separate panel or cover can be associated with the promotional system of the present invention with the panel or cover incorporating an arm or linkage connected to the activation panel for causing the activation panel to move in the desired direction whenever the cover is arcuately pivoted. Furthermore, the construction can be integrated into numerous alternate promotional systems and concepts, such as automatically erected boxes, polygons, and the like, wherein automatic movement of the cut out sections is achieved simultaneously with the movement of the entire assembly between a closed flat configuration into a three-dimensional configuration.

The invention accordingly comprises an article of manufacture possessing the features, properties, and relation of elements which will be exemplified in the article hereinafter described, and the scope of the invention will be indicated in the claims.

THE DRAWING

Figure 3:
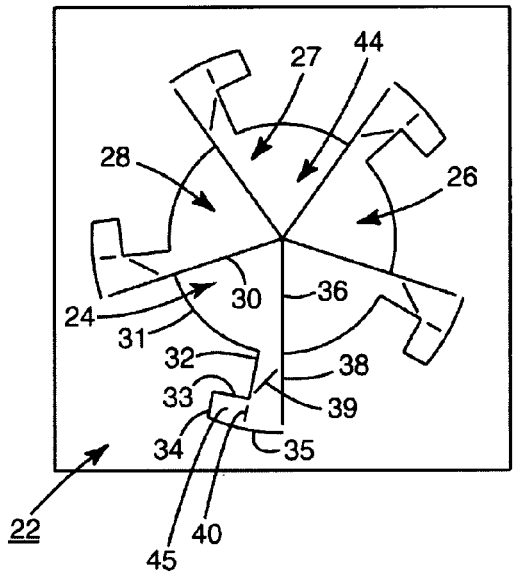
Figure 2:
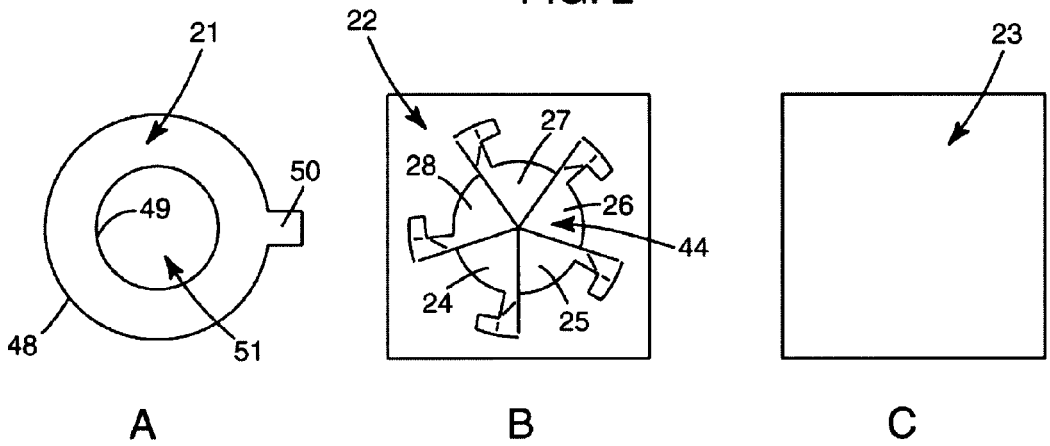
Figure 4:
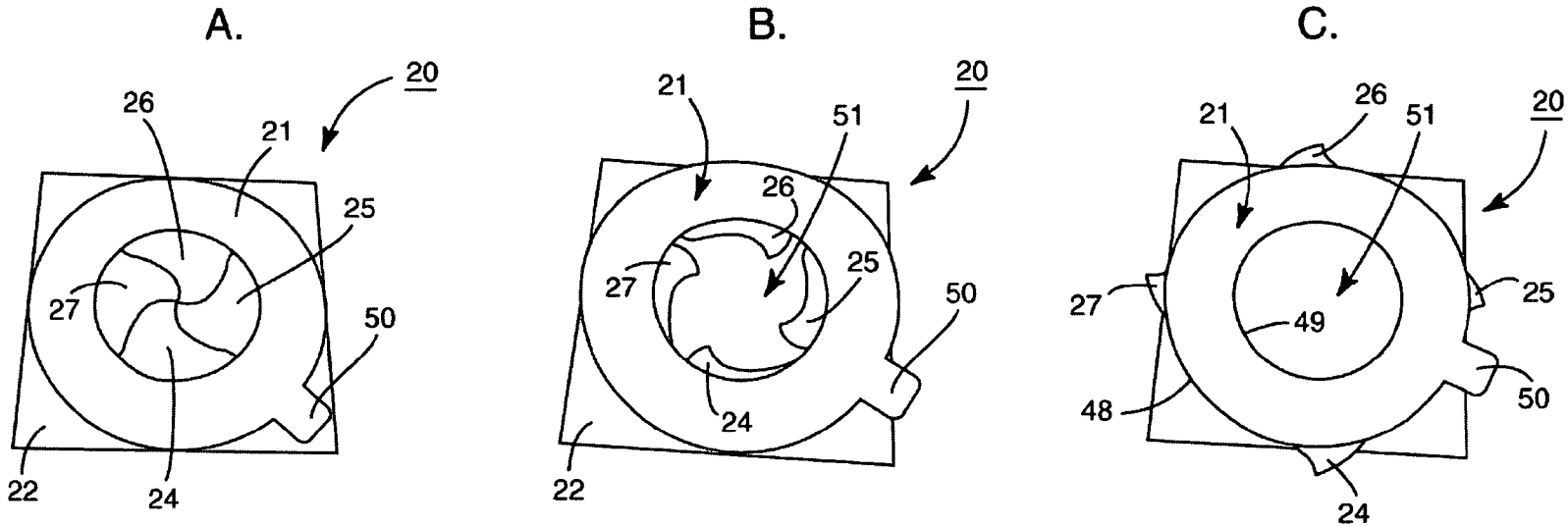
Figure 5:
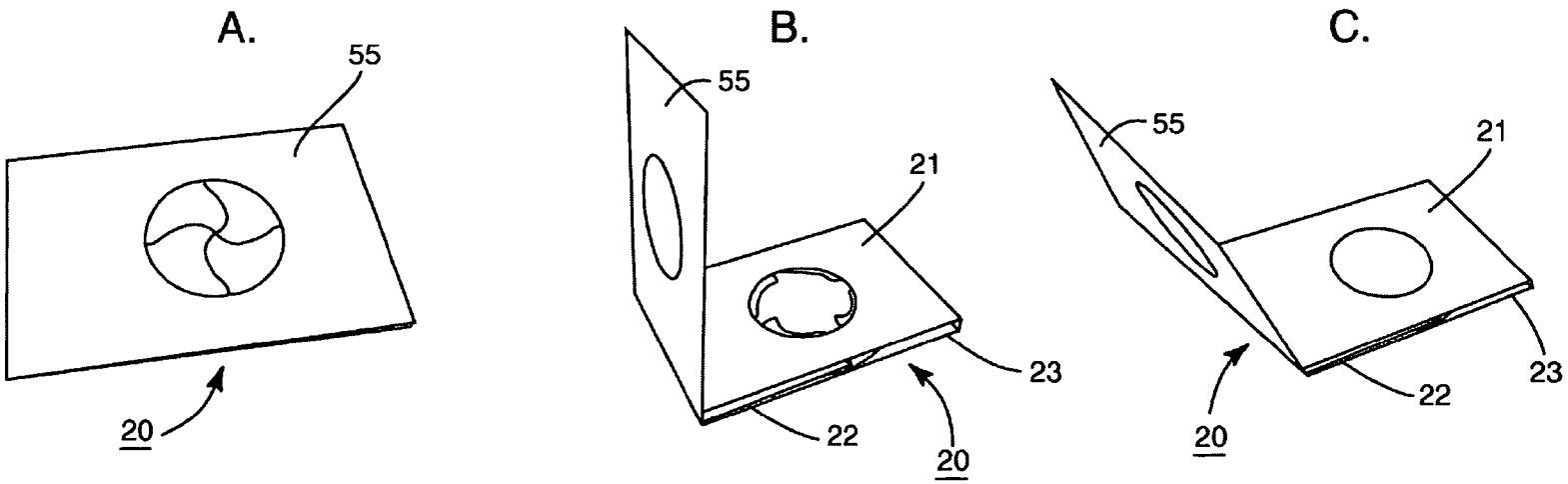
Figure 6:
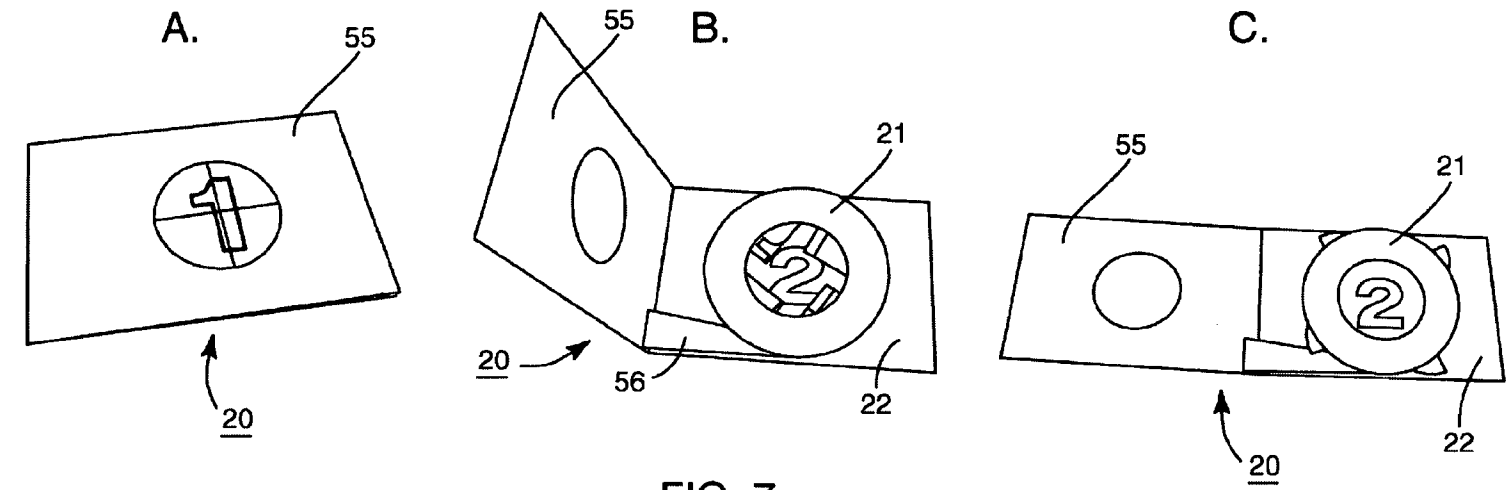
Figure 7:
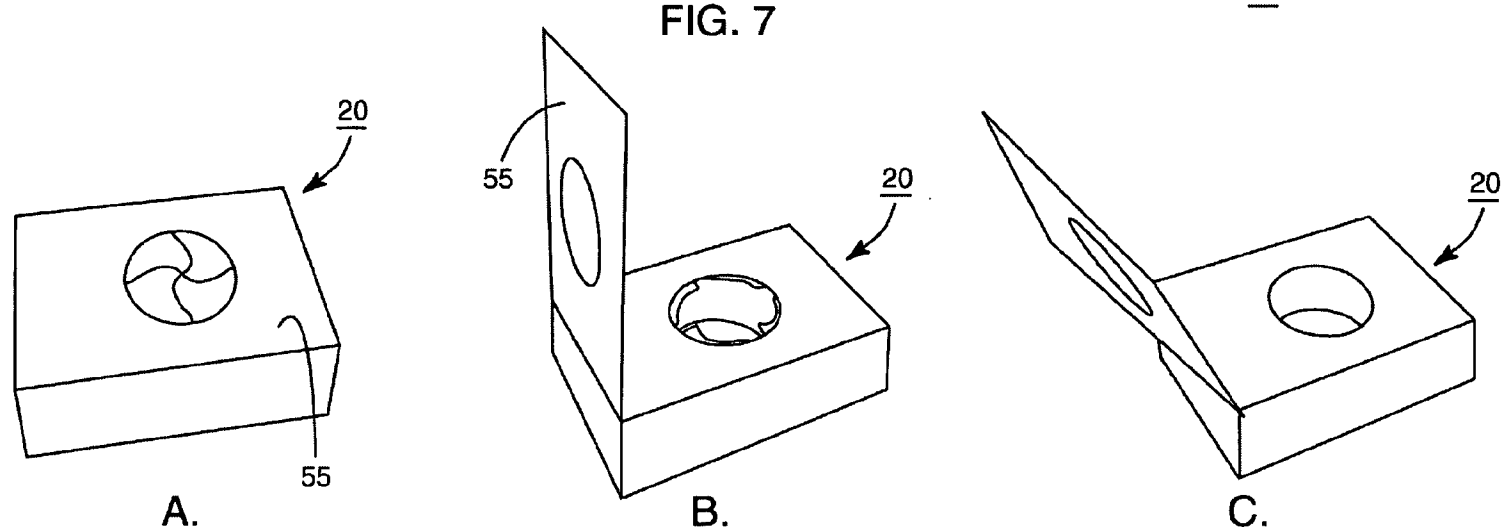
Figure 8:
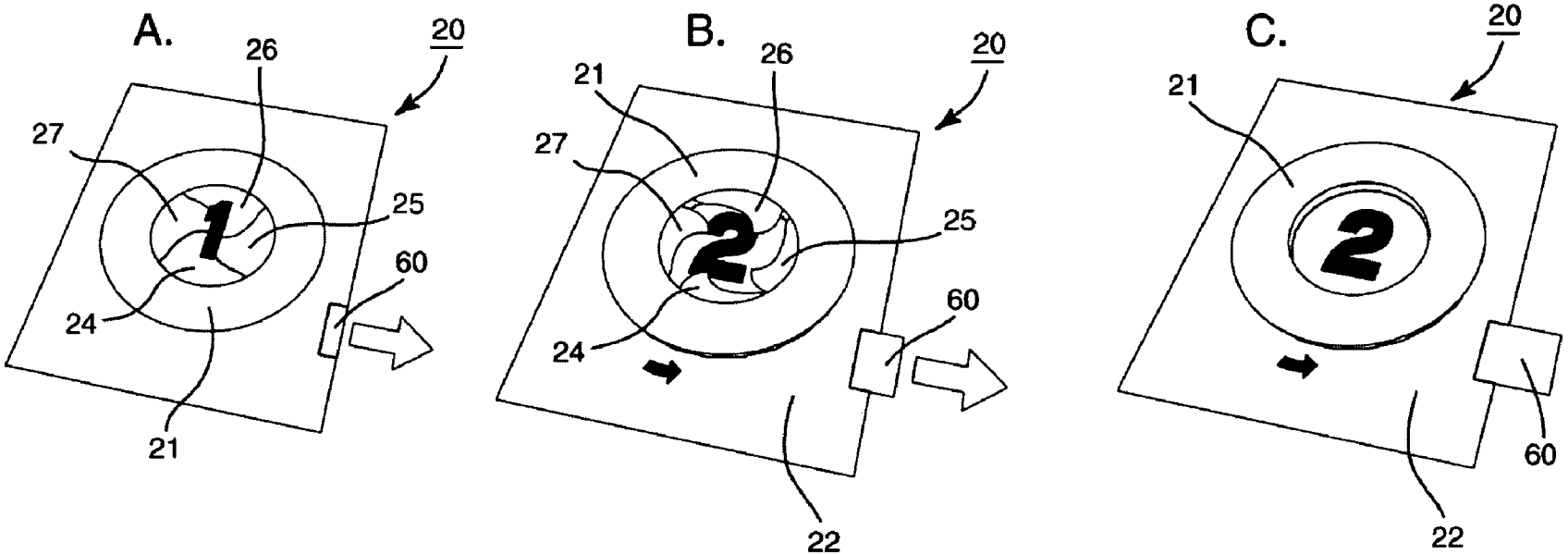
Figure 9:
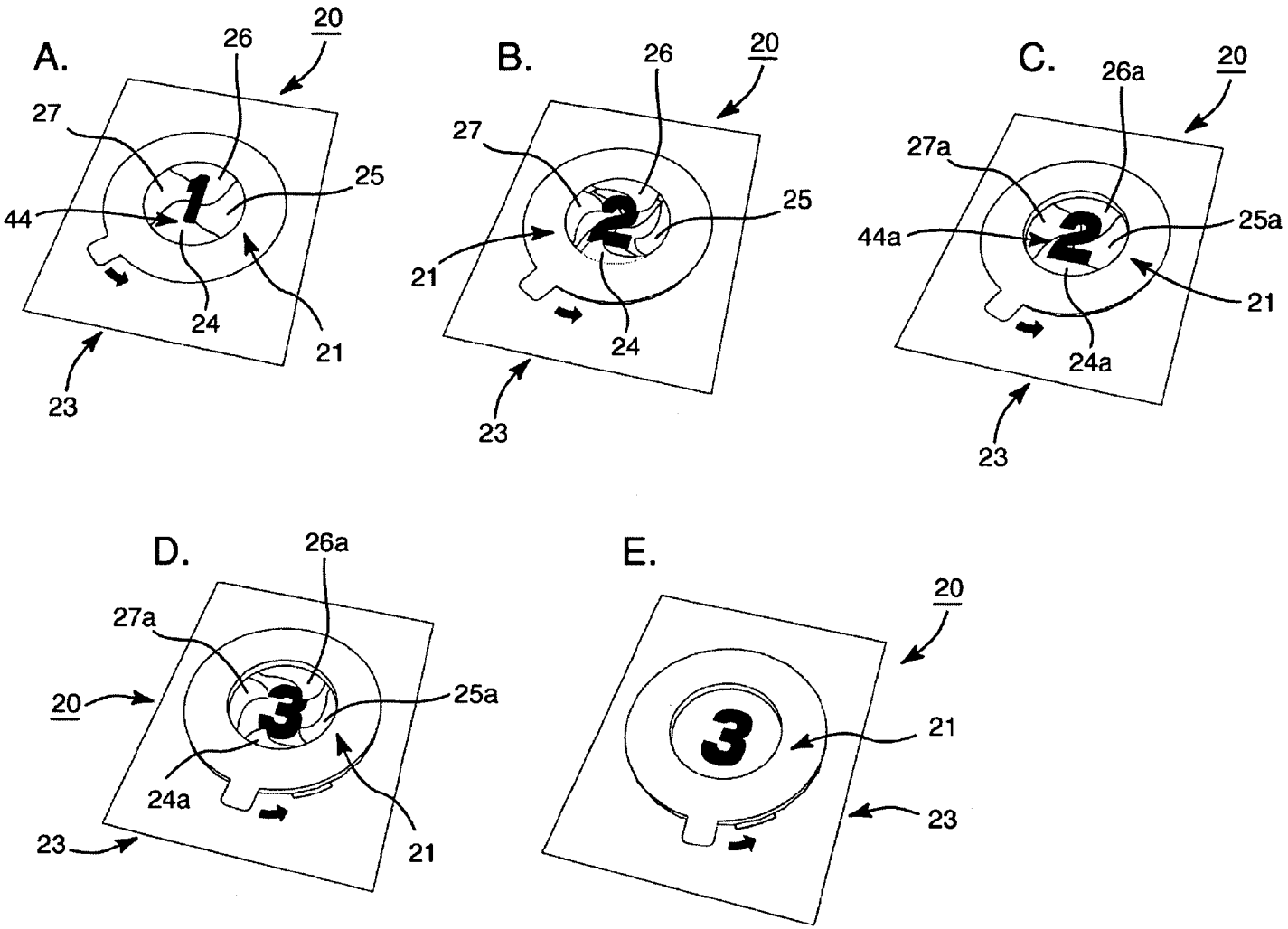

For a fuller understanding of the nature and objects of the invention, reference should be had to the following detailed description taken in connection with the accompanying drawings, in which:

FIG. 1 is an exploded perspective view of one embodiment of the promotional system of the present invention;

FIG. 2, which consists of three separate elements designated A, B, and C, are top plan views of each of the components forming the promotional system of FIG. 1;

FIG. 3 is a greatly enlarged top plan view of the element shown in FIG. 2B;

FIG. 4, which consists of three elements designated A, B, and C, are top plan views of the fully assembled promotional system depicted in FIGS. 1 and 2, with the promotional system being moved from its closed position to its open position;

FIG. 5, which consists of three elements designated A, B, and C, are top plan views of an alternative embodiment of the promotional system of the present invention with the promotional system being moved from its closed position to its open position;

FIG. 6, which consists of three elements designated A, B, and C, are top plan views of a further alternate embodiment of the promotional system of the present invention with the promotional system being moved from its closed position to its open position;

FIG. 7, which consists of three elements designated A, B, and C, are top plan views of a still further alternate embodiment of the promotional system of the present invention with the promotional system being moved from its closed position to its open position;

FIG. 8, which consists of three elements designated A, B, and C, are top plan views of a further alternate embodiment of the promotional system of the present invention with the promotional system being moved from its closed position to its open position; and FIG. 9 which consists of five elements designated A, B, C, D, and E are top plan views of a still further alternate embodiment of the promotional system of the present invention with the promotional system being moved from its closed position to its open position.

DETAILED DISCLOSURE

By referring to FIGS. 1-9, along with the following detailed discussion, the preferred construction and operation of several alternate embodiments of the promotional system of the present invention can best be understood. In addition to the embodiments disclosed herein, further alternate variations in the construction and operation of the present invention can be made without departing from the scope of the present invention. Consequently, it is to be understood that the following drawings as well as the following detailed disclosure is provided for exemplary purposes only and is not intended as a limitation of the present invention.

As clearly depicted in FIGS. 1 and 2, promotional system 20 of the present invention preferably incorporates activation plate 21, panel member 22, and support panel 23. As detailed above, support panel 23 is optional, and may be eliminated by incorporating an integrally formed base or bottom surface with panel member 22. Furthermore, as discussed above, activation plate 21 may comprise any desired size, shape, or configuration. In addition, other alterations in variations can be made without departing from the scope of the present invention.

In accordance with the present invention, one of the principal elements incorporated into promotional system 20 is panel member 22. As shown in FIGS. 1, 2, and 3, panel member 22 incorporates a plurality of movable sections 24, 25, 26, 27, and 28, each of which are constructed to move independently from the remainder of panel member 22. Furthermore, the particular shape or configuration employed for forming movable sections 24, 25, 26, 27, and 28 can be widely varied. However, by referring to the following detailed discussion, the overall construction and operation of movable sections 24, 25, 26, 27, and 28 can best be understood.

In order to best understand the preferred construction of movable sections 24, 25, 26, 27, and 28, the following detailed discussion focuses upon the construction of movable section 24, with it being understood that each other movable section is constructed in a substantially identical manner. In this regard, movable section 24 is cut away and independently movable from member 22, with lines 30, 31, 32, 33, 34, 35, and 36 representing the cut or separation lines peripherally surrounding movable section 24.

Line 38 of movable section 24 comprises a fold line and remains as the only portion of movable section 24 which is affixed to panel member 22. In addition, line 38, extends from cut line 36 of movable section 24 to cut line 35 of movable section 24 and is folded for enabling movable section 24 to pivot along fold line 38. Furthermore, each cut line 31 of movable sections 24, 25, 26, 27, and 28 combine to form central display area or zone 44 which comprises an integral component of panel member 22 and incorporates indicia, message, image, visual display, or the like desired by the manufacturer or user to provide an eye-catching, distinctive component of promotional system 20. As detailed below, the indicia, message, image, visual display, or the like, formed in central display area/zone 44 represents one component of a desired promotional message, with the second component of the promotional message being formed on support panel 23, or other cooperating components of panel member 22, which is revealed when movable sections 24, 25, 26, 27, and 28 are arcuately pivoted into their second position.

In order to achieve the desired arcuate pivoting movement of sections 24, 25, 26, 27, and 28, each of the movable sections also incorporates fold lines 39 and 40 formed thereon. As is more fully detailed below, by forming fold lines 39 and 40 in the positions shown in FIG. 3, each movable section is able to arcuately pivot in a precisely desired controlled manner between its first position and its second position. In this regard, each of movable section 24, 25, 26, 27, and 28 arcuately pivot from a first position, wherein each of the movable sections are mounted directly adjacent each other, as shown in FIGS. 1, 2, and 3, into a second position, wherein each of the movable sections are pivoted away from central display area/zone 44 for revealing the additional message, display, image, etc. formed directly below on support panel 23.

In order to achieve the desired arcuate pivoting movement of sections 24, 25, 26, and 27, tab 45, which is formed by cut line 33, 34, and 35, is employed. In the preferred construction, activation plate 21 is placed in overlying, juxtaposed cooperating relationship with panel member 22, with tab 45 of each movable section 24, 25, 26, 27, and 28 being affixed to the bottom surface of activation plate 21.

In addition, in the embodiment depicted, activation plate 21 comprises a generally circular shape defined by outside edge 48 and inside edge 49, which effectively establishes an enlarged central aperture 51. In the preferred embodiment, as depicted, the diameter of inside edge 49 is substantially equivalent to the diameter of central display area/zone 44. In this way, when activation plate 21 is mounted to panel member 22 in the desired manner, with tabs 45 affixed thereto, central display area/zone 44 is fully visible through aperture 51 formed by inside edge 49 of activation plate 21.

Once activation plate 21 is mounted to panel member 22 with tabs 45 of each of movable section 24, 25, 26, 27, and 28 affixed to the lower surface of activation plate 21, promotional system 20 is fully assembled and ready for use. In this regard, in the preferred embodiment, support panel 23 is mounted as the bottom element of promotional system 20, with support panel 23 being securely affixed to the bottom surface of panel member 22.

Once fully assembled, with each component incorporating an eye-catching, distinctive, exciting and interest generating display, information, message, image, etc. desired by the manufacturer or user, promotional system 20 is ready for use. In order to activate promotional system 20, one of the several alternate constructions or activation systems can be employed. In FIG. 4, promotional system 20, substantially identical to the promotional system depicted in FIGS. 1-3 and detailed above, is shown fully assembled and ready for employing manual activation to control the movement of cooperating movable sections. In the construction shown in FIG. 4, four movable sections 24, 25, 26, and 27 are depicted, as opposed to the five movable section shown in FIG. 1-3.

In the preferred construction of this embodiment of the present invention, activation plate 21 incorporates holding flange 50 radially extending outwardly from outside edge 48 of activation plate 21. By employing holding flange 50, the user is able to easily control the movement of activation plate 21 and movable sections 24, 25, 26, and 27.

As discussed above, in assembling this embodiment of promotional system 20, each tab 45 of each of movable section is affixed to the bottom surface of activation plate 21, with central aperture 51 formed by inside edge 49 being aligned with central display area/zone 44 of panel member 22. In this way, the indicia printed on movable sections 24, 25, 26, and 27, which define central display area/zone 44, is readily viewable through enlarged aperture 51 of activation plate 21.

In order to enable the user to manually activate promotional system 20 of the present invention, and reveal the additional information, indicia, message, etc. printed on support panel 23, the user would manually grab holding flange 50 and arcuately pivot activation plate 21 relative to panel member 22. This arcuate pivoting movement causes movable sections 24, 25, 26, and 27 to pivot therewith, with each section moving about fold lines 38, 39 and 40. Since tab 45 of each movable section is affixed to activation plate 21, the movement of activation plate 21 forces each of the movable sections to pivot therewith about the cooperating fold lines.

By forming fold lines 38, 39 and 40 in the manner detailed above, movable sections 24, 25, 26, and 27 arcuately pivot principally about fold line 38, causing each movable section to move from a position of visibility through aperture 51 to a position wherein each movable section is substantially hidden below activation plate 21. As a result, the eye-catching printed indicia, message, information, etc. printed on movable sections 24, 25, 26, and 27 disappears from view, revealing the second eye-catching, visual information, indicia, message, etc. printed on support panel 23.

By employing cooperating or complementary information, displays, images, etc. on movable section 24, 25, 26, and 27 as well as on support panel 23, a unique, interest generating and information providing promotional system 20 is realized. Furthermore, this embodiment of the present invention provides a promotional system wherein the user is able to repeatedly participate in the activation and movement of the cooperating sections for repeatedly moving the sections between their first position and their second position. In this way, all of the desired attributes for a promotional system are realized and a unique, interest generating, visually exciting, informative promotional system is attained.

In FIGS. 5 and 6, two alternate embodiments for constructing an automatically activated promotional system in accordance with the present invention is depicted. In each of these embodiments, promotional system 20 incorporates an overlying cover or panel 55 which is intimately connected with activation plate 21, panel member 22, and support panel 23 of the construction. In each of these embodiments, the arcuate pivoting movement of cover 55 causes activation plate 21 to move in the desired direction for effectively achieving the arcuate pivoting movement of the associated movable sections.

In the embodiment depicted in FIG. 5, the pivoting movement of cover 55 causes the dual layer construction of activation plate 21 and panel member 22 to move relative to each other, thereby forcing movable sections 24, 25, 26, and 27 to move between their two alternate positions. Furthermore, cover 55 preferably comprises an enlarged aperture 58 formed therein which is dimensioned for enabling central display area/zone 44 of panel member 22 to be visible whenever cover 55 overlies panel 22. In this way, the promotional information printed thereon can be seen and enjoyed.

Similarly, in the embodiment depicted in FIG. 6, the arcuate pivoting movement of cover 55 causes arm 56 to move simultaneously therewith. Since arm 56 is connected directly to activation plate 21, the movement of arm 56 causes activation plate 21 to move in the desired manner, effectively activating movable sections 24, 25, 26, and 27 to move from their first position to their second position. In this way, this embodiment of promotional system 20 achieves the desired automatic activation for enabling the user to observe the interest generating indicia, message, information display, etc. formed on movable sections 24, 25, 26, and 27, as well as on panel member 22 in central display area/zone 44.

In FIG. 7, an automatic activation system is depicted, wherein promotional system 20 is incorporated into a box configuration. In this embodiment, cover or panel 55 is employed for activating movable sections 24, 25, 26, and 27, in a manner either equivalent to the embodiment depicted in FIG. 5 or 6. However, in addition to moving sections 24, 25, 26, and 27 between their first and second positions, by incorporating a box construction in association therewith, central display area/zone 44 can define the interior of the associated box, thereby allowing a prize, gift, or other physical object to be easily reached by inserting a hand through aperture 51. In this way, a further dimension and added value to promotional system 20 of the present invention is realized.

In FIGS. 8 and 9, two further additional embodiments of the present invention are fully depicted. In each of these embodiments, promotional system 20 is manually activated. However, in the embodiment depicted in FIG. 8, the manual activation of activation plate 21 is achieved by employing pull tab 60.

Preferably, promotional system 20 depicted in FIG. 8 is constructed in a manner substantially identical to the construction detailed above in reference to FIGS. 1-4. In addition, however, pull tab 60 is sandwiched between panel member 22 and support panel 23, with pull tab 60 directly connected to activation plate 21. As a result, whenever pull tab 60 is moved outwardly from its first, stowed position, as depicted in FIG. 8A, the outward movement causes activation plate 21 to arcuately pivot, causing cut-out sections 24, 25, 26, and 27 to move from their first position into their second position.

As depicted in FIG. 8B, when pull tab 60 is partially drawn away from panel member 22 and support panel 23, movable sections 24, 25, 26, and 27 become partially opened, with the complete opening thereof being achieved when pull tab 60 is extended outwardly from panel member 22 and support panel 23 to its full extent, as depicted in FIG. 8C. By employing this embodiment of the present invention, an alternate construction is achieved for enabling promotional system 20 to be quickly and easily activated by the user.

In this way, the user is able to repeatedly participate in the activation movement of the cooperating sections, repeatedly moving the sections between their first position and their second position. As a result, all of the desired attributes of the promotional system of the present invention are realized and the unique, interest generating and visually exciting information printed thereon, along with the message to be conveyed, is realized.

In FIG. 9, a further alternate embodiment of the present invention is depicted. In this embodiment, promotional system 20 is constructed in a manner substantially similar to the construction detailed above in reference to FIGS. 1-4. However, in order to provide a further unique and surprising display construction, this embodiment of promotional system 20 incorporates two separate and independent layers of movable sections, thereby providing a total of three independent viewable messages, other than the two independent messages provided by the embodiments detailed above.

As shown in FIG. 9, this embodiment of promotional system 20 incorporates a single activation plate 21 which is constructed for arcuate movement relative to movable sections 24, 25, 26, and 27. As with the embodiments detailed above, whenever activation plate 21 is arcuately moved, movable sections 24, 25, 26, and 27 are simultaneously moved from their first display position to their second withdrawn position as represented in FIGS. 9A-9C. However, in this embodiment, a second layer of movable sections 24A, 25A, 26A, and 27A are positioned below the first set of movable sections for being displayed when the first set of movable sections have been moved into their second withdrawn position.

Furthermore, in accordance with the construction of this embodiment of the present invention, the continued arcuate movement of activation plate 21 causes the second set of movable sections 24A, 25A, 26A, and 27A, to be moved from their first display position into their second withdrawn position, as represented by FIGS. 9C-9E. In this way, any desired indicia can be printed on the exposed surfaces of movable sections 24, 25, 26, 27, and 28, as well as on the surfaces of movable sections 24A, 25A, 26A, and 27A. In addition, any desired indicia may also be printed on the surface of support panel 23, for being displayed only when in the second set of movable sections have been controllably moved into their second position.

As a result of this construction, promotional system 20 is capable of enabling a user to provide three separate and distinct levels of printed indicia in the single promotional system 20. As a result, any desired added information, messages, logos, displays, colors, graphics, etc. can be conveyed to the user in a unique promotional product which is capable of providing an added and surprising level of interest and excitement to the user.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sentence.

It is also to be understood that the following claims are intended to cover all of the generic and specific features of the invention herein described, and all statements of the scope of the invention which, as a matter of language, might be said to fall therebetween.

Having described my invention, what I claim is new and desire to secure by Letters Patent is:

1. An advertising/promotional product constructed for providing enhanced interest and excitement to the user comprising:

A. a first panel incorporating a plurality of sections formed therein with each of said sections being a) positioned in cooperating, side to side relationship with adjacent sections, b) constructed for having side edges thereof in abutting relationship with the side edges of each adjacent section, c) movable between a first display position, wherein said sections are adjacent to each other, and a second position wherein said sections are withdrawn from each other; and d) cooperating to form a unitary display zone with each of said sections forming a part of said display zone, and B. an activating plate a) mounted in overlying controlling relationship with said first panel, b) movable relative to said first panel, c) incorporating an enlarged central opening formed therein, dimensioned for overlying the display zone of the first panel and enabling the display zone to be viewable therethrough, and d) constructed for being arcuately movable relative to the first panel and controllably moving each of said sections simultaneously between their first and second positions whenever the activating plate is moved relative to the first panel;

whereby the advertising/promotional product is realized which is completely controlled by the user for opening and closing the sections of the first panel whenever desired for enabling a message or promotion to be sequentially displayed.

2. The advertising/promotional product defined in claim 1, wherein said display zone comprises a generally circular shape and each of said sections comprises a segment of said circular shape.

3. The advertising/promotional product defined in claim 1, wherein said activating plate is further defined as being affixed to a portion of each of said sections for causing each of said sections to move independently whenever said activating plate is arcuately pivoted.

4. The advertising/promotional product defined in claim 3, wherein each of said sections is further defined as incorporating fold lines formed therein, with each of said fold lines being constructed for causing the section to move simultaneously with the movement of the activating plate and enable each section to move from its first display position to its second position wherein the section is withdrawn from the display zone.

5. The advertising/promotional product defined in claim 4, wherein each of said sections comprises 1. a display portion formed for cooperating association with the display portion of the adjacent sections and forming, in their entirety, a desired promotional message to be viewable, and
2. a base portion mounted to an outer edge of the display portion and affixed to the first panel and incorporating tab portions formed adjacent to the fold lines for enabling the display portion of said section to be movable between its first position and its second position.

6. The advertising/promotional product defined in claim 1, wherein said advertising/promotional product further comprises:

C. a support panel constructed for receiving and supportingly maintaining the first panel and the activating plate when mounted thereto.

7. The advertising/promotional product defined in claim 6, wherein the support panel further comprises advertising or promotional information printed thereon in aligned relationship with the plurality of sections formed on the first panel for enabling said advertising/promotional information to be viewable whenever said sections are moved into their second position.

8. The advertising/promotional product defined in claim 6, wherein said advertising/promotional product further comprises:

D. a second panel mounted to the first panel along at least one edge thereof for arcuate pivoting movement relative thereto, with said second panel being interconnected to the activating plate for moving the activating plate whenever said second panel is arcuately pivoted.

9. The advertising/promotional product defined in claim 1, wherein said plurality of sections each comprise indicia formed thereon constructed for cooperating with each other for displaying a single message, and the exposed surface of the activating plate comprises additional indicia formed thereon.

10. The advertising/promotional product defined in claim 9, wherein said indicia comprises one or more selected from the group consisting of printed matter, messages, promotional information, colors, slogans, logos, graphics, and cutout zones.

11. An advertising/promotional product constructed for providing enhanced interest and excitement to the user comprising:

A. a first panel incorporating a plurality of sections formed therein with each of said sections a) being in cooperating, side to side a relationship with adjacent sections for forming a display zone with each of said sections forming a part of said display zone, b) being movable between a first display position, wherein said sections are adjacent to each other, and a second position wherein said sections are withdrawn from each other, and c) having side edges thereof in abutting relationship with the side edges of each adjacent section;

B. an activating plate a) mounted in overlying controlling relationship with the first panel, b) movable relative to said first panel, c) incorporating an enlarged central opening formed therein, dimensioned for overlying the display zone of the first panel and enabling the display zone to be viewable therethrough, and d) constructed for controllably moving each of said sections simultaneously between their first and second positions whenever the activating plate is moved relative to the first panel; and C. a control member cooperatively associated with the first panel and the activating plate for causing the activating plate to move relative to the first panel whenever the control member is activated by the user, whereby the user is able to quickly and easily cause the plurality of sections to move between their first and second positions.

12. The advertising/promotional product defined in claim 11, and further defined as comprising a support assembly incorporating a supporting base and arcuately pivotable cover associated therewith for controllably moving the activating plate relative to the first panel via the control member, with said arcuately pivotable cover incorporating an enlarged aperture formed therein and dimensioned for enabling the display zone to be viewable therethrough.

13. The advertising/promotional product defined in claim 12, wherein said supporting base is further defined as comprising two panels mounted to each other in juxtaposed, spaced, cooperating, vertically aligned relationship, affixed to each other along at least two side edges, with the one of said panels incorporating the enlarged aperture formed therein which is positioned for alignment with the display zone and enables the display zone to be viewable therethrough.

14. The advertising/promotional product defined in claim 12, wherein said supporting base is further defined as comprising a generally rectangular shaped box configuration, with a top panel of the box configuration comprising the activating plate and the first panel, and the arcuately pivotable cover incorporates the aperture formed in alignment with the display zone, whereby gifts or prizes can be retained in the box configuration and become accessible whenever a plurality of sections are moved from their first position into their second positions.

* * * * *